US011059057B2

(12) United States Patent
Melle

(10) Patent No.: US 11,059,057 B2
(45) Date of Patent: Jul. 13, 2021

(54) SHOWER HEAD HAVING AN OVERPRESSURE VALVE

(71) Applicant: Hansgrohe SE, Schiltach (DE)

(72) Inventor: Fabian Melle, Durbach (DE)

(73) Assignee: Hansgrohe SE, Schiltach (DE)

( * ) Notice: Subject to any disclaimer, the term of this patent is extended or adjusted under 35 U.S.C. 154(b) by 0 days.

(21) Appl. No.: 16/255,787

(22) Filed: Jan. 23, 2019

(65) Prior Publication Data

US 2019/0224696 A1 Jul. 25, 2019

(30) Foreign Application Priority Data

Jan. 24, 2018 (DE) ..... 10 2018 201 109.5

(51) Int. Cl.
*B05B 1/30* (2006.01)
*B05B 1/18* (2006.01)
(Continued)

(52) U.S. Cl.
CPC ..... *B05B 1/3006* (2013.01); *B05B 1/18* (2013.01); *B05B 12/087* (2013.01); *B05B 15/50* (2018.02); *B05B 15/654* (2018.02); *B05B 1/185* (2013.01)

(58) Field of Classification Search
CPC ..... B05B 1/1609; B05B 1/12; B05B 1/18; B05B 1/185; B05B 1/36; B05B 15/50;
(Continued)

(56) References Cited

U.S. PATENT DOCUMENTS 6,185,760 B1 * 2/2001 Park ..... E03C 1/04 4/678
8,474,482 B2 * 7/2013 Melle ..... F16K 31/563 137/625.11
(Continued)

FOREIGN PATENT DOCUMENTS

AT 252 826 B 3/1967
CH 442165 8/1967
(Continued)

OTHER PUBLICATIONS

Search Report issued by the European Patent Office, Munich, Germany, dated Jul. 2, 2019 for European Patent Application No. 19152805.8.
(Continued)

*Primary Examiner* — Joseph A Greenlund
(74) *Attorney, Agent, or Firm* — Bose McKinney & Evans LLP

(57) ABSTRACT

A shower head, illustratively for a sanitary shower, including a shower head housing, a fluid inlet into the shower head housing, a shower jet outlet out of the shower head housing, a fluid duct within the shower head housing from the fluid inlet to the shower jet outlet, and an overpressure valve pressure-coupled to the fluid duct, including a movable valve body which, in case of an overpressure in the fluid duct, moves from a normal position to an overpressure position. The valve body is illustratively configured to be self-retaining in the overpressure position and returnable to the normal position by user operation, and/or the valve body acts position-dependent on a passage cross-section of the fluid duct, wherein the valve body reduces the passage cross-section in the overpressure position relative to the normal position.

16 Claims, 2 Drawing Sheets

(51) Int. Cl.
*B05B 12/08* (2006.01)
*B05B 15/654* (2018.01)
*B05B 15/50* (2018.01)

(58) Field of Classification Search
CPC . B05B 15/654; F16K 17/0466; F16K 17/168; F16K 17/025
USPC ..... 239/562; 137/625.12, 625.13
See application file for complete search history.

(56) References Cited

U.S. PATENT DOCUMENTS

| | | | | |
|---|---|---|---|---|
| 9,199,252 | B2 * | 12/2015 | Schorn | B05B 1/18 |
| 9,539,590 | B2 * | 1/2017 | Vorel | B05B 1/12 |
| 9,901,939 | B2 * | 2/2018 | Lin | B05B 1/169 |
| 2006/0163391 | A1 * | 7/2006 | Schorn | A61H 33/027 239/596 |
| 2010/0301141 | A1 * | 12/2010 | Pan | F16K 31/3855 239/449 |
| 2012/0181462 | A1 * | 7/2012 | Zhou | B05B 1/18 251/129.01 |
| 2013/0312175 | A1 * | 11/2013 | Huffington | B05B 15/654 4/615 |
| 2016/0228898 | A1 * | 8/2016 | Bruder | B05B 11/00442 |
| 2017/0043358 | A1 * | 2/2017 | Zhang | B05B 1/1618 |
| 2017/0259279 | A1 * | 9/2017 | Lin | B05B 15/65 |
| 2018/0104707 | A1 * | 4/2018 | Lin | E03C 1/06 |
| 2019/0224696 | A1 * | 7/2019 | Melle | B05B 15/654 |
| 2020/0023387 | A1 * | 1/2020 | Nikles | B05B 15/654 |

FOREIGN PATENT DOCUMENTS

| | | | | |
|---|---|---|---|---|
| CN | 202527296 | U | | 11/2012 |
| CN | 103611643 | A | | 3/2014 |
| CN | 104971834 | A | * | 10/2015 |
| CN | 104971834 | A | | 10/2015 |
| DE | 10 2015 003 607 | A1 | | 9/2016 |
| EP | 1619315 | A1 | | 1/2006 |
| EP | 2848315 | A1 | | 3/2015 |
| EP | 3053655 | A1 | | 8/2016 |
| RU | 2534088 | C1 | | 11/2014 |
| RU | 2620436 | C2 | | 5/2017 |

OTHER PUBLICATIONS

Search Report and Decision to Grant in Russian language with English translation issued by The Federal Service for Intellectual Property, Patents and Trademarks (ROSPATENT), dated Jul. 25, 2019, for Russian Patent Application No. 2019101432/05(002324).

Office Action issued by the National Intellectual Property Administration, P.R. China, dated Jul. 15, 2020, for Chinese Application No. 201910068872.4 (with English language translation including corrected art citation), 6 pages.

* cited by examiner

SHOWER HEAD HAVING AN OVERPRESSURE VALVE

CROSS-REFERENCE TO RELATED APPLICATION

This application claims priority to German Patent Application No. DE 10 2018 201 109.5, filed on Jan. 24, 2018, the disclosure of which is expressly incorporated herein by reference.

BACKGROUND AND SUMMARY OF THE DISCLOSURE

The invention relates to a shower head, comprising a shower head housing, a fluid inlet into the shower head housing, a shower jet outlet out of the shower head housing, a fluid duct within the shower head housing from the fluid inlet to the shower jet outlet, and an overpressure valve pressure-coupled to the fluid duct, including a movable valve body which, in case of an overpressure within the fluid duct, moves from a normal position to an overpressure position.

It is a known fact with shower heads of this kind that, after a certain operating time, the fluid pressure in the shower head housing can rise in an unwanted manner beyond a normal fluid operating pressure range, i.e. an overpressure state occurs, owing to dirt particles and/or lime scale deposits, which, especially at the shower jet outlet, can lead to cross-sectional constrictions or even blockages of jet outlet openings. This problem occurs to a greater extent, for example, on shower heads which have jet outlet openings of relatively small diameter at the shower jet outlet and/or which are used with relatively hard water in sanitary showers. In the present case, overpressure refers to a pressure which is above a normal pressure range in which the fluid pressure in the fluid duct lies in normal operation during correct use of the shower head and fault-free operation thereof, taking into account normal pressure fluctuations, e.g. in an upstream fluid supply.

These shower heads therefore have an overpressure valve which responds in the event of an overpressure in the fluid duct in the fluid head housing in order to avoid prolonged operation of the shower head in such an overpressure state. For this purpose, the overpressure valve is pressure-coupled to the fluid duct, i.e. coupled in terms of pressure, with the result that the overpressure in the fluid duct acts on the overpressure valve and moves the movable valve body thereof into the overpressure position. As long as the fluid pressure in the fluid duct is in the normal pressure range and an overpressure has not yet occurred, the valve body occupies its normal position, i.e. its position intended for normal showering operation of the shower head.

In a shower head of this kind disclosed in Patent Publication AT 252 826, an overpressure safety feature is provided by exposing an additional outlet cross-section by the expansion of an elastic closure. More specifically, for this purpose a ring provided with an annular groove and preferably of substantially V shaped cross-section is provided in an annular gap left free between a jet disk on the outlet side, which is normally provided with a plurality of jet outlet openings, and an adjoining part of the shower head housing, wherein the additional outlet cross-section is in the form of openings, which are arranged on the bottom of the annular groove and which are closed off by an elastic seal ring, such as an O-ring, which expands elastically when there is an overpressure in the fluid duct in the shower head housing and thereby exposes the otherwise closed openings. When there is no longer an overpressure in the fluid duct, the seal ring returns automatically once again, by virtue of its elasticity, to the state in which it closes the overpressure openings.

It is an object of the invention to provide a shower head of the type stated at the outset which offers improvements over the abovementioned prior art, especially as regards functionality in respect of the overpressure behavior.

An illustrative embodiment of the invention achieves this and other objects by providing a shower head comprising a shower head housing, a fluid inlet into the shower head housing, a shower jet outlet out of the shower head housing, a fluid duct within the shower head housing from the fluid inlet to the shower jet outlet, and an overpressure valve pressure-coupled to the fluid duct. The overpressure valve illustratively includes a movable valve body which, in case of an overpressure within the fluid duct, moves from a normal position to an overpressure position, wherein the valve body is configured to be self-retaining in the overpressure position and returnable to the normal position by user operation, and/or the valve body acts position-dependent on a passage cross-section of the fluid duct, wherein the valve body reduces the passage cross-section in the overpressure position relative to the normal position.

In this shower head, according to one aspect of the invention, the valve body is configured to be self-retaining in the overpressure position and returnable to the normal position by user operation. In the present case, the term "self-retaining" refers to the characteristic of the valve body that, when it has moved into its overpressure position due to an overpressure in the fluid duct, it also remains in this position when the overpressure is no longer present in the fluid duct. The return movement of the valve body from its overpressure position to its normal position is accomplished by user actuation and therefore not automatically. This gives the user the opportunity first of all to clarify the cause of the overpressure and, if appropriate, to clean the shower head, in particular the shower jet outlet, if the overpressure is caused by dirt particles and/or lime scale deposits of the kind which can often occur, especially at the shower jet outlet. The user can then move the valve body back from its overpressure position to its normal position, ensuring that the shower head is once again in its normal operating state.

According to an additional or alternative aspect of the invention, the valve body acts in a position-dependent manner on a passage cross-section of the fluid duct, wherein the valve body reduces the passage cross-section in the overpressure position relative to the normal position. According to this aspect of the invention, the overpressure valve does not ensure that an additional overpressure opening is exposed or that there is a corresponding increase in the overall fluid outlet cross-section of the shower head in the case of overpressure, as compared with normal operation, but ensures a reduction in the passage cross-section of the fluid duct from the fluid inlet to the shower jet outlet. This reduces the volume flow of fluid passed through the shower head. The volume flow reduction may be so great, for example, that the fluid only drips in individual droplets from the shower head. This encourages the user to intervene or to service the shower head.

Thus, in each of its stated aspects, the invention reliably and advantageously avoids a situation where the shower head is operated for a prolonged time with excessive pressure in the shower head housing.

In a development of the invention, the shower jet outlet comprises a plurality of j et outlet openings, and the fluid duct comprises a manifold chamber upstream of the jet outlet openings. The valve body acts on the passage cross-section of the fluid duct between the fluid inlet and the manifold chamber. As a result, the valve body can reduce the passage cross-section of the fluid duct at this point when an overpressure occurs in the fluid duct, thereby making it possible to reduce the volume flow of fluid into the manifold chamber. As a result, the overpressure in the manifold chamber can be dissipated via the jet outlet openings and an indication can be given to the user by the reduced volume flow that there is a case of overpressure.

In a development of the invention, the valve body is cylindrical and movable within the shower head housing in axial direction and comprises a radially protruding annular collar including at least one valve passage opening. The fluid duct comprises a valve chamber in which the valve body with its annular flange is guided for axial movement, as well as at least one valve inlet opening leading into the valve chamber, and at least one valve outlet opening leading out of the valve chamber. The valve body with its annular collar reduces a passage cross-section of the at least one valve outlet opening in the overpressure position relative to the normal position. In this embodiment, the annular collar thus serves as a kind of movable valve closing body which exposes the at least one valve outlet opening when the valve body is in its normal position and blocks or closes the valve outlet opening at least partially, i.e. completely or partially, when the valve body is in the overpressure position.

In one embodiment of the invention, the at least one valve inlet opening extends axially, as does the at least one valve passage opening. In the normal position of the valve body, the valve passage opening is in alignment with the valve inlet opening. This represents an implementation of the fluid duct in this region which is advantageous in terms of design and flow engineering.

In one embodiment of the invention, the shower head in the shower head housing comprises a hollow cylindrical valve seat body on which the valve body is held for guided movement and in which the valve chamber is located. The at least one valve outlet opening extends with a radial directional component outwards through a cylinder surface section of the valve seat body, optionally additionally with an axial directional component. This design measure is also advantageous for the overpressure valve in terms of flow engineering and operation.

In a development of the invention, the shower head comprises a jet disk forming the shower jet outlet, and the valve body is located on a same side of the shower head housing as the jet disk. Since the jet disk side of a shower head is generally the side of the shower head which faces the user during operation or which he can at any rate easily see and is easily accessible to him, this measure has the advantage that the user can readily identify the valve body and its respective instantaneous position and can easily handle it when required, e.g. to move it back from its overpressure position to its normal position.

In one embodiment of the invention, the valve body in the overpressure position projects beyond the exterior side of the jet disk, whereas, in the normal position, it does not project beyond the exterior side of the jet disk, i.e. is flush therewith or, alternatively, is set back relative thereto. As a result, the user can detect very easily from the position of the valve body relative to the jet disk whether or not there is a case of overpressure.

In a development of the invention, the overpressure valve comprises a magnet arrangement which retains the valve body in the normal position by a magnetic force, wherein the magnetic force can be overridden by an overpressure in the fluid duct but not by the pressure forces of any normal fluid pressure fluctuations in the fluid duct during normal, fault-free operation of the shower head. In this case, the magnetic force decreases in strength with increasing distance of the valve body from the normal position down to an irrelevance value in the overpressure position. In the present case, the term "irrelevance value" means that the value of the magnetic force in the overpressure position is equal to zero or at any rate so small that the magnetic force is no longer capable of moving the valve body automatically back from its overpressure position to its normal position while overcoming normal frictional forces and any residual fluid pressure forces, even when the case of overpressure is no longer present, i.e. the overpressure in the fluid duct has been dissipated. In other words, the magnetic force has no relevance for the return motion of the valve body from its overpressure position to the normal position. The user can therefore decide for himself when he wants to move the valve body back into its normal position, for which purpose he can actuate it accordingly. In the normal position, the valve body is then once again retained by the action of the magnetic force.

Additional features and advantages of the present invention will become apparent to those skilled in the art upon consideration of the following detailed descriptions of the illustrative embodiment best exemplifying the best mode of carrying out the invention as presently perceived.

BRIEF DESCRIPTION OF THE DRAWINGS

Advantageous embodiments of the invention are illustrated in the drawings and described below, wherein further advantageous embodiments according to the invention are mentioned and explained in addition. In the drawings.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Figure 1:
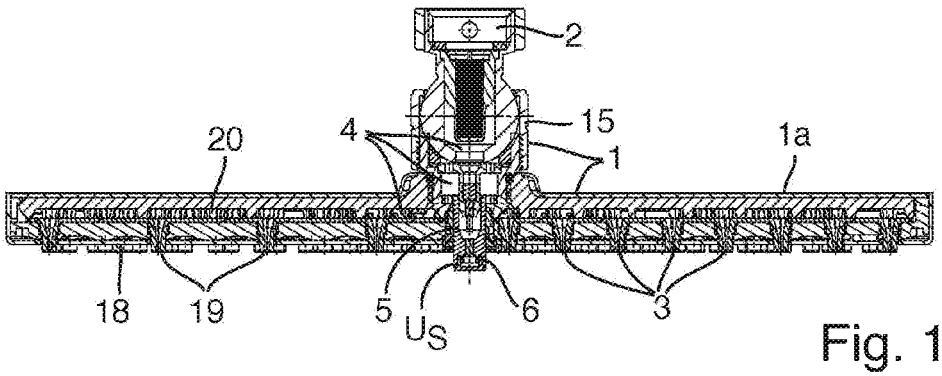
FIG. 1 shows a longitudinal section through a shower head.
Figure 2:
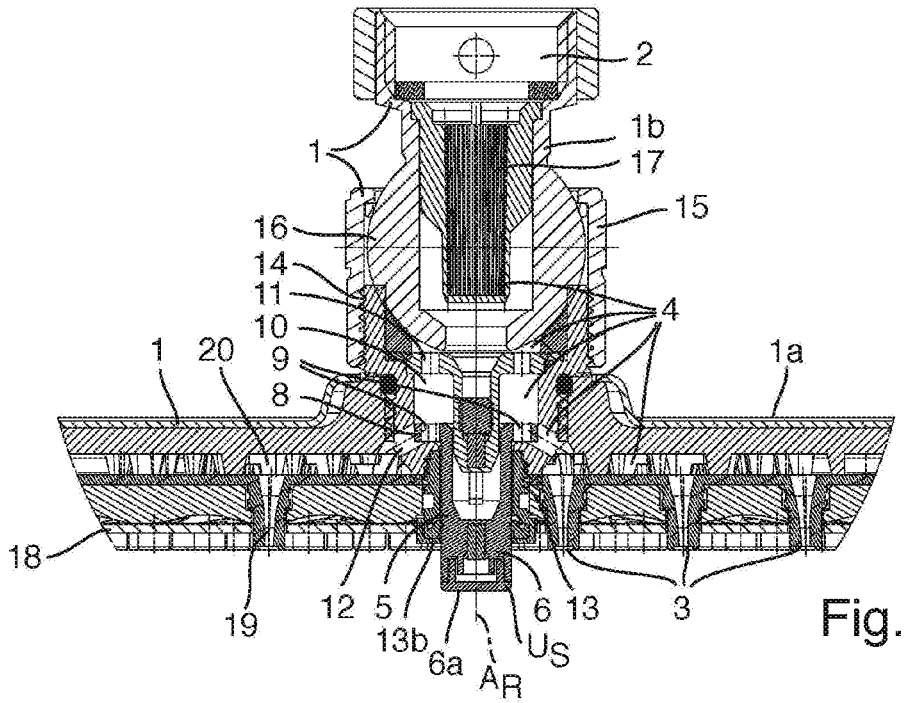
FIG. 2 shows a detail longitudinal section through a central region of the shower head in FIG. 1.

The shower head shown in FIGS. 1 and 2 comprises a shower head housing 1, a fluid inlet 2 into the shower head housing 1, a shower jet outlet 3 out of the shower head housing 1, a fluid duct 4 within the shower head housing from the fluid inlet 2 to the shower jet outlet 3, and an overpressure valve 5. The overpressure valve 5 is pressure-coupled to the fluid duct 4, i.e. a fluid pressure prevailing in the fluid duct 4 in a corresponding region, to which the overpressure valve 5 is operatively coupled, acts on the overpressure valve 5. The overpressure valve 5 installed in the shower head shown in FIGS. 1 and 2 is illustrated in greater detail in FIGS. 3 to 7. It is self-evident that this overpressure valve can also be used in other shower heads.

Figure 3:
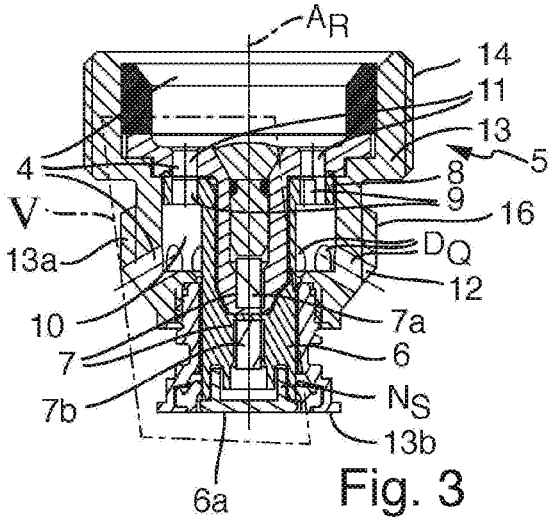
FIG. 3 shows a longitudinal section through an overpressure valve having a valve body in the normal position, it being possible to use the overpressure valve in the shower head in FIG. 1.
Figure 4:
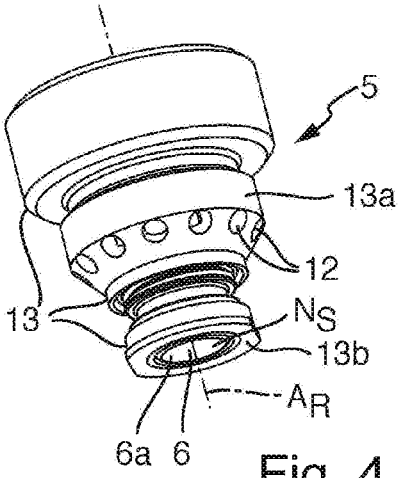
FIG. 4 shows a perspective view of the overpressure valve in FIG. 3.
Figure 5:
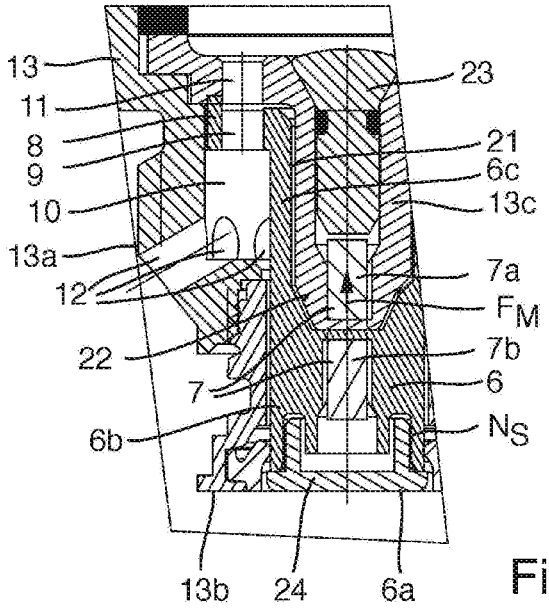
FIG. 5 shows a detail view of a region V in FIG. 3.
Figure 6:
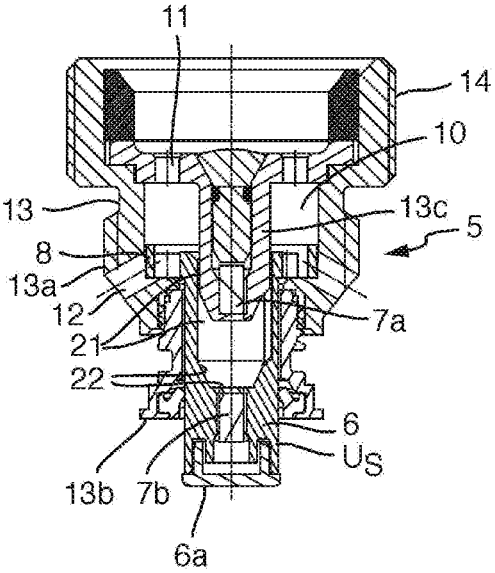
FIG. 6 shows the view in FIG. 3 with the valve body in the overpressure position.
Figure 7:
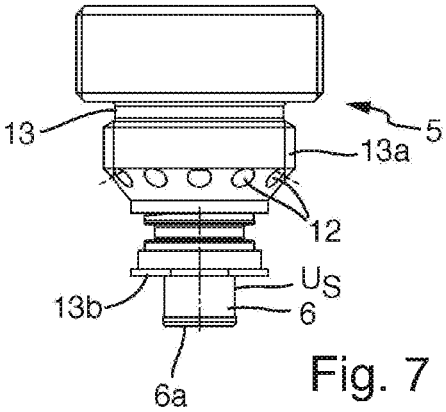
FIG. 7 shows a side view of the overpressure valve in the overpressure position as per FIG. 6.

The overpressure valve 5 includes a movable valve body 6 which, in case of an overpressure within the fluid duct 4, moves from a normal position $N_S$, shown in FIGS. 3 to 5, to an overpressure position $U_S$, shown in FIGS. 6 and 7 and in the installed state of FIGS. 1 and 2.

In corresponding embodiments of the invention, the valve body 6 is configured to be self-retaining in the overpressure position $U_S$ and returnable to the normal position $N_S$ by user operation. This means that, when the valve body 5 has adopted its overpressure position owing to an overpressure in the fluid duct 4, the valve body 5 remains in the overpressure position $U_S$ until the user moves it back into the normal position $N_S$, even if the overpressure is in the meantime no longer present in the fluid duct 4.

In the illustrative embodiment shown, the overpressure valve 5 has a magnet arrangement 7 for this purpose, the magnet arrangement 7 retaining the valve body 6 in the normal position $N_S$ by a magnetic force $F_M$ overridable by an overpressure in the fluid duct 4, wherein the magnetic force $F_M$ decreases in strength with increasing distance of the valve body 6 from the normal position $N_S$ down to an irrelevance value in the overpressure position $U_S$. In alternative embodiments, the overpressure valve includes some other conventional source of a retaining force instead of a magnet arrangement of this kind, the source subjecting the valve body in the normal position $N_S$ to a retaining force that can be overridden by the overpressure in the fluid duct 4 and that no longer acts on the valve body 6 in the overpressure position $U_S$ or, at least, is no longer sufficiently strong to be able to move the valve body 6 back into the normal position $N_S$ itself when the overpressure is no longer present.

In the illustrative embodiment shown, the magnet arrangement 7 is formed by two interacting magnets 7*a*, 7*b*, of which a first magnet 7*b* is arranged in the or on the valve body 6 and a second magnet 7*a* is arranged in or on a part of the overpressure valve 5 which remains stationary. The two magnets 7*a*, 7*b* can be permanent magnets, for example, and can provide the magnetic force $F_M$ as a magnetic force of attraction between the two magnets 7*a*, 7*b*, which, as is conventional, decreases rapidly in strength with increasing distance between the two magnets 7*a*, 7*b*. The magnets 7*a*, 7*b* are suitably chosen to ensure that, in the normal position $N_S$ of the valve body 6, in which they are the shortest distance apart, they provide the magnetic force $F_M$ with the strength required to hold the valve body 6 in its normal position $N_S$, while, in the overpressure position $U_S$ of the valve body 6, in which the two magnets 7*a*, 7*b* are at the furthest distance apart, the magnetic force $F_M$ has fallen virtually to zero or, at any rate, to an extent sufficient to ensure that it is no longer capable of moving the valve body 6 back into the normal position $N_S$ against any frictional forces and any fluid pressure forces that may be present.

In corresponding embodiments of the invention, the valve body 6 acts in a position-dependent manner on a passage cross-section $D_Q$ of the fluid duct 4, such that it reduces the passage cross-section $D_Q$ in the overpressure position $U_S$ relative to the normal position $N_S$.

In the illustrative embodiment shown, the valve body 6 is cylindrical and movable within the shower head housing 1 in axial direction $A_R$, wherein, as is conventional, axial direction $A_R$ should be taken to mean the direction parallel to a longitudinal central axis of the cylindrical valve body 6, and the direction opposite thereto. The valve body 6 comprises a radially protruding annular collar 8 including at least one valve passage opening 9. The fluid duct 4 comprises a valve chamber 10 in which the valve body 6 with its annular collar 8 is guided for axial movement. The fluid duct 4 furthermore has at least one valve inlet opening 11 leading into the valve chamber 10, and at least one valve outlet opening 12 leading out of the valve chamber 10. The valve body 6 with its annular collar 8 reduces the passage cross-section $D_Q$ of the at least one valve outlet opening 12 when the valve body 6 is in the overpressure position $U_S$ relative to the operating state when the valve body 6 is in the normal position $N_S$. In other words, the valve body 6 reduces the passage cross-section $D_Q$ of the fluid duct 4 in the region of the at least one valve outlet opening 12 in the example shown. In alternative embodiments, the valve body acts at a different point of the fluid duct 4 on the passage cross-section $D_Q$ of the latter in such a way as to make it smaller when an overpressure occurs. The reduction in size can consist in that the passage cross-section $D_Q$ is completely shut off, i.e. reduced to zero, or, alternatively, to some other desired, reduced cross-sectional value between the value zero and a maximum value which the passage cross-section $D_Q$ has at the relevant point of the fluid duct 4 when the valve body 6 is in the overpressure position $U_S$.

The valve chamber 10, the at least one valve inlet opening 11 and the at least one valve outlet opening 12 can all be formed on the overpressure valve 5, for example. In the example shown, the valve chamber 10 is in the form of an annular cylinder but, alternatively, it can have some other form, e.g. the form of a full cylinder. In corresponding embodiments, a plurality of valve inlet openings 11 and valve passage openings 9 is provided in each case, the openings being arranged equidistantly in the circumferential direction in each case, for example.

In corresponding embodiments, both the at least one valve inlet opening 11 and the at least one valve passage opening 9 extend purely axially, i.e. parallel to the axial direction $A_R$, wherein the at least one valve passage opening 9 extends axially in alignment with the at least one valve inlet opening 11 when the valve body 6 is in the normal position $N_S$. In alternative embodiments, the at least one valve inlet opening and/or the at least one valve passage opening extends at least partially obliquely or perpendicularly to the axial direction $A_R$. The flush transition from the respective valve inlet opening 11 to the respective valve passage opening 9 enables the fluid to enter the valve chamber 10 unhindered via the at least one valve inlet opening 11, through the at least one valve passage opening 9, in the normal position $N_S$ of the valve body 6.

In the example shown, the respective valve passage opening 9 of the valve body 6 lies opposite, with no clearance or at most a small clearance, the respective valve inlet opening 11 in an associated front end region of the valve chamber 10 in the normal position $N_S$. In the overpressure state $U_S$, the annular collar 8 of the valve body 6 is in the other front end region of the valve chamber 10 and consequently at a significant distance from the valve inlet opening or openings 11, and therefore the one or more valve inlet openings 11 are not shut off by the valve body 6, even in the case of overpressure.

In corresponding embodiments, the overpressure valve 5 comprises a hollow cylindrical valve seat body 13 on which the valve body 6 is held guided and in which the valve chamber 10 is located. In this case, the at least one valve outlet opening 12 extends with a radial directional component outwards through a cylinder surface section 13*a* of the valve seat body 13.

In the example shown, the valve seat body 13 is manufactured from a plurality of assembled parts while, in alternative embodiments, it is manufactured in one piece. In the example shown, it is provided in one front end region with an external thread 14, by means of which it can be screwed into an internal thread of a joint sleeve 15 of the shower head 1, as shown. In the example shown, the valve seat body 13 furthermore has, in an axially central region, an external thread 16, to which a shower outlet part 1*a* of the shower head housing 1 is screwed. In alternative embodiments, the valve seat body 13 can be connected to the shower head housing in some other conventional manner.

In the example shown, the shower outlet part 1*a* is manufactured with a flat shower construction, thereby making the shower head in FIGS. 1 and 2 suitable particularly as a flat overhead shower of the kind known for use in sanitary shower rooms or shower installations. The shower outlet part 1*a* is coupled in an articulated manner, by means of a ball joint 16, to a shower head connection part 1*b*, via which the shower head can be connected to a fluid supply and which forms the fluid inlet 2. In alternative embodiments, the shower head is not configured in this flat construction but is of some other conventional design, e.g. a bell-shaped design. As shown, a screen element 17 is optionally arranged as a dirt/particle screen in the fluid duct section of the shower head connection part 1*b* between the fluid inlet 2 and the at least one valve inlet opening 11.

Apart from the overpressure valve 5, the shower outlet part 1*a* has a construction that is known per se, which ends on the fluid outlet side with a jet disk 18, which forms the shower jet outlet 3 and is provided with one or, usually, a multiplicity of jet outlet openings 19, which are arranged in a pre-determinable configuration over an outlet surface, e.g. a circular or rectangular surface, of the jet disk 18.

In corresponding embodiments, as in the example shown, the fluid duct 4 comprises a manifold chamber 20 upstream of the jet outlet openings 19, from which manifold chamber the jet outlet openings 19 lead and into which the at least one valve outlet opening 12 leads. In this shower head, the valve body 6 thus acts on the passage cross-section $D_Q$ of the fluid duct 4 between the fluid inlet 2 and the manifold chamber 20, in this case specifically between the valve chamber 10 and the manifold chamber 20.

In corresponding embodiments, the valve body 6 is located on a same side of the shower head housing 1 as the jet disk 18 forming the shower jet outlet 3. In the illustrative embodiment shown, the valve body 6 is located specifically in a central region of the jet disk 18. In alternative embodiments, the valve body 6 is arranged eccentrically with respect to the jet disk 18.

In corresponding embodiments, the valve body 6 in the overpressure position $N_S$ projects beyond the exterior side of the jet disk 18. The shower head is shown in this state in FIGS. 1 and 2. In the normal position $N_S$, the valve body 6 does not project beyond the exterior side of the jet disk 18, i.e. it is positioned set back relative thereto within the shower head housing 1 or ends substantially flush with the exterior side of the jet disk 18. The latter case is implemented in the example shown, i.e. in the normal position $N_S$ an exterior side 6*a* of the valve body 6 is flush with an exterior side 13*b* of the valve seat body 13, which, for its part, ends substantially flush with the exterior side of the jet disk 18.

As can be seen especially from FIG. 5, a central pin 13*c* is formed on the valve seat body 13 in the illustrative embodiment shown, the pin 13*c* delimiting the annular valve chamber 10 radially on the inside and being capable of acting as an additional aid for the guidance of the valve body 6, for which purpose the valve body 6 is of correspondingly hollow cylindrical design in an associated section 6*c* axially between its annular collar 8 on the foot side and a head section 6*b* ending with the exterior side 6*a*. A pressure duct 21 is formed between this hollow cylindrical section 6*c* of the valve body 6 and the central pin 13*c* of the valve seat body 13, the duct 21 being in fluid communication with the valve chamber 10 and leading axially forwards as far as an end face 22 of the valve body head section 6*b*.

In corresponding embodiments, the pressure duct 21 comprises one or more radial gaps extending axially or with an axial directional component, it being possible, for example, for each of the gaps to be formed by a groove extending axially or with an axial directional component on the outside of the central pin 13*c* and/or on the inside of the hollow cylindrical valve body section 6*c*. As an alternative, an annular gap which is continuous in the circumferential direction can be provided as a pressure duct 21, or spacing webs extending axially or with an axial directional component can be provided on at least one of these two opposite surfaces, between which webs the interspaces forming the pressure duct 21 are then present.

In the illustrative embodiment shown, the central pin 13*c* serves simultaneously to retain the second magnet 7*a*, while the first magnet 7*b* is arranged in the head section 6*b* of the valve body 6. The magnets 7*a*, 7*b* can there be fitted into corresponding holes which can, by way of example, be closed by means of a sealing screw 23 on the part of the central pin 13*c* and by means of a covering cap 24 defining the exterior side 6*a* of the valve body 6 on the part of the valve body 6. As an alternative, these magnet insertion holes can remain unclosed or can be closed in some other way.

In the illustrative embodiment shown, the respective valve outlet opening 12 leads out of the valve chamber 10, in a region of the chamber 10 which is at the bottom in the figures, and extends radially outwards and axially forwards or outwards, i.e. downwards in the figures, through the relevant cylinder surface section 13*a* of the valve seat body 13, which can be of conically tapered configuration in this region, for example, as shown. In the example shown, a plurality of valve outlet openings 12 is provided in a manner distributed equidistantly in the circumferential direction. The number of valve outlet openings 12 can correspond to the number of valve passage openings 9 or differ therefrom.

In the normal state $N_S$, the annular collar 8 of the valve body 6 is situated in the inner or rear end region of the valve chamber 10, i.e. that at the top in the figures, wherein the respective valve passage opening 9 is in alignment opposite the associated valve inlet opening 11 and opens into this region of the pressure duct 21. The valve outlet openings 12 are fully exposed without the valve body 6 restricting the passage cross-section $D_Q$ of the fluid duct 4, which is determined by the overall configuration of the shower head. Fluid supplied via the fluid inlet 2 consequently reaches the shower jet outlet 3 via the fluid duct 4 in this normal mode of the shower head, and emerges from there as a corresponding shower jet. To be more precise, during this process the fluid flows via the valve inlet openings 11 and the valve passage openings 9 into the valve chamber 10 and, from there, via the valve outlet openings 12 into the manifold chamber 20, from where it is distributed between the jet outlet openings 19.

As long as the fluid can flow substantially without hindrance and in a trouble-free manner, no overpressure occurs in the fluid duct 4. Since the pressure duct 21 is not located in the main flow of the fluid duct 4, it is not subject to any significant fluid pressure during the normal operation of the shower head and, in all cases, any fluid pressure force thereby possibly exerted on the valve body 6, on the end face 22 of its head section 6*b*, in an outward direction or downwards in the figures remains lower than the opposing attractive magnetic force $F_M$ of the two magnets 7*a*, 7*b*. Particularly after a relatively long period of operation of the shower head, relatively small particles and/or lime scale deposits can lead to constriction or blockages in the fluid duct 4 and particularly in the region of the shower jet outlet 3. This applies particularly to shower heads in which the jet outlet openings 19 have only relatively small passage cross-sections, as is the case, for example, with sanitary showers which release what is referred to as a fine or needle jet as a shower jet. As a result, an overpressure may occur in the fluid duct 4, i.e. a raised fluid pressure which is too high, higher than the fluid pressure in the normal shower mode, including normal pressure fluctuations, e.g. those caused by fluctuating pressure conditions in an upstream fluid supply. Such an overpressure is unwanted and can cause damage in the shower head housing 1. This is prevented by the overpressure valve 5.

If an overpressure occurs in the fluid duct 4, e.g. in the manifold chamber 20, this leads to a corresponding overpressure in the valve chamber 10 of the overpressure valve 5 pressure-coupled to the fluid duct 4. The overpressure in the valve chamber 10 also forces the fluid into the pressure duct 21, as a result of which the fluid presses with the corresponding overpressure against the end face 22 of the valve body 6. The magnet arrangement 7 is configured in such a way that the magnetic force $F_M$ provided by it in the normal position $N_S$ of the valve body 6 is lower than the oppositely acting fluid overpressure force which is exerted by the fluid under overpressure on the valve body 6, on the end face 22 thereof. As a result, the valve body 6 is released from its normal position $N_S$, counter to the magnetic force $F_M$, and, following the fluid overpressure force, moves axially forwards or outwards, i.e. downwards in the figures, as far as its overpressure position $U_S$, which represents the end position of the valve body 6 opposite to the normal position $N_S$. Given appropriate system design, this extension movement of the valve body 6 counter to the magnetic force $F_M$ and counter to any frictional forces and counter to the ambient pressure acting on the exterior side 6*a* of the valve body 6 can additionally be supported by an entrainment effect of a residual flow of fluid in the valve chamber 10. It is self-evident that the overpressure valve 5 responds also when the shower head is connected to a fluid supply, the fluid supply pressure of which is higher than that for which the shower head is designed.

In the overpressure position $U_S$, the annular collar 8 of the valve body 6 blocks the respective valve outlet opening 12 completely or, alternatively, partially, as can be seen, for example, in FIGS. 2 and 5. In this overpressure position $U_S$, the valve body 6 thereby reduces the passage cross-section $D_Q$ of the fluid duct 4 at this point to zero or, at least, to a value lower than the effective passage cross-section of the fluid duct 4 during normal operation. This has the effect that the volume flow of the fluid at the shower outlet 3 is greatly reduced in corresponding fashion. For the user, this can be detected easily from the fact that the shower jet stops or that the shower head then only drips at the shower outlet 3. Moreover, the user can detect the case of overpressure which has occurred from the fact that the valve body 6 has moved into its extended overpressure position $U_S$ and therefore projects forwards or outwards beyond the exterior side of the jet disk 18. As an option, the valve body 6 can be produced in such a way that its color is set off from the surrounding jet disk region, at least in its region projecting beyond the jet disk 18. This can make it even easier for the user to detect the fact that the overpressure valve 5 has responded.

Owing to the at least partial blockage of the valve outlet opening or openings 12, the fluid can no longer flow into the manifold chamber 20, or can no longer flow into it in a significant quantity, in the overpressure position $U_S$ of the valve body 6, and therefore overpressure which is initially present there can dissipate through the escape of the remaining fluid at the shower outlet 3. The user can then take the required measures, e.g. that of cleaning the shower head as a whole or at least at the shower outlet 3, i.e. can remove the cause of the case of overpressure which has occurred. During this process, the valve body 6 initially remains in its overpressure position $U_S$ since the two magnets 7*a*, 7*b* are now so far apart that they no longer exert any, or at least no significant, magnetic force on the valve body 6, i.e. the magnet arrangement 7 is not capable of automatically pulling the valve body 6 back into the normal position $N_S$. Once the user has removed the cause of the fluid overpressure, they push the valve body 6 back into its normal position $N_S$, e.g. by pressing with one finger against the exterior side 6*a* of the valve body 6. In other words, the head section 6*b* of the valve body 6 in the example shown forms, as it were, a valve pin which the user can push back into the retracted normal position $N_S$ from the extended overpressure position $U_S$.

The magnetic force $F_M$ of the magnet arrangement 7 then once again holds the valve body 6 in its normal position $N_S$. In the normal position $N_S$, the valve body 6 once again completely exposes the passage cross-section $D_Q$ of the fluid duct 4, in the example shown by completely exposing the valve outlet openings 12. The shower head is thus once again ready for use.

As the illustrative embodiments shown and mentioned above make clear, the invention makes available a shower head with an advantageous overpressure valve function. Damage to the shower head can be avoided by means of the integrated overpressure valve. In corresponding implementations of the shower head, the overpressure valve can ensure a reduction in the fluid volume flow, thus enabling the overpressure to dissipate through the escape of residual fluid from the shower head, preferably via the shower jet outlet, without fluid emerging at the overpressure valve itself. In corresponding implementations of the shower head, the user can easily detect a case of overpressure, remove the causes of the overpressure and then move the valve body back from its overpressure position to its normal position under the user's own control.

It is self-evident that the shower head according to the invention can be used both for any type of sanitary shower and for non-sanitary showers if and to the extent that there is a need to protect the shower head from any fluid overpressure in the fluid duct.

Although the invention has been described in detail with reference to certain preferred embodiments, variations and modifications exist within the spirit and scope of the invention as described and defined in the following claims.

The invention claimed is:

1. A shower head comprising:

a shower head housing;

a fluid inlet into the shower head housing;

a shower jet outlet of the shower head housing;

a fluid duct within the shower head housing from the fluid inlet to the shower jet outlet wherein, during use of the shower head under normal showering operation of the shower head, the fluid pressure in the fluid duct falls within a normal operating pressure range; and an overpressure valve pressure-coupled to the fluid duct, including a movable valve body which, in case of an overpressure state within the fluid duct wherein the fluid pressure in the fluid duct is higher than the normal operating pressure range, moves the valve body from a normal position to an overpressure position;

wherein the valve body is configured to be self-retaining in the overpressure position, so as to remain in the overpressure position when the overpressure state is no longer present, and returnable to the normal position by user operation.

2. The shower head according to claim 1, wherein:

the shower jet outlet comprises a plurality of jet outlet openings; and the valve body acts on the passage cross-section of the fluid duct between the fluid inlet and the manifold chamber.

3. The shower head according to claim 1, wherein:

the valve body is cylindrical and movable within the shower head housing in an axial direction and comprises a radially protruding annular collar including at least one valve passage opening; and the fluid duct comprises a valve chamber in which the valve body with its annular collar is guided for axial movement, at least one valve inlet opening leading into the valve chamber, and at least one valve outlet opening leading out of the valve chamber;

wherein the valve body with its annular collar reduces a passage cross-section of the at least one valve passage opening in the overpressure position relative to the normal position.

4. The shower head according to claim 3, wherein in that the at least one valve inlet opening extends axially and the at least one valve passage opening extends axially and in the normal position of the valve body in alignment to the at least one valve inlet opening.

5. The shower head according to claim 3, wherein the overpressure valve comprises a hollow cylindrical valve seat body on which the valve body is held guided and in which the valve chamber is located, wherein the at least one valve outlet opening extends with radial directional component outwards through a cylinder surface section of the valve seat body.

6. The shower head according to claim 1, further comprising a jet disk forming the shower jet outlet, wherein the valve body is located on a same side of the shower head housing as the jet disk.

7. The shower head according to claim 6, wherein the valve body in the overpressure position projects beyond an exterior side of the jet disk and in the normal position does not project beyond the exterior side of the jet disk.

8. The shower head according to claim 1, wherein the over pressure valve has a magnet arrangement which retains the valve body in the normal position by a magnetic force overridable by an overpressure in the fluid duct, wherein the magnetic force decreases in strength with increasing distance of the valve body from the normal position down to an irrelevance value in the overpressure position.

9. A shower head comprising:

a shower head housing;

a fluid inlet into the shower head housing;

a shower jet outlet out of the shower head housing;

a fluid duct within the shower head housing from the fluid inlet to the shower jet outlet wherein, during use of the shower head under normal showering operation of the shower head, the fluid pressure in the fluid duct falls within a normal operating pressure range; and an overpressure valve pressure-coupled to the fluid duct, including a movable valve body which, in case of an overpressure state within the fluid duct wherein the fluid pressure in the fluid duct is higher than the normal operating pressure range, moves the valve body from a normal position to an overpressure position;

wherein the valve body acts position-dependent on a passage cross-section of the fluid duct through which fluid passes during use of the shower head under normal showering operation of the shower head, wherein the valve body reduces the passage cross-section in the overpressure position relative to the normal position so as to reduce a volume flow of fluid passed through the shower head.

10. The shower head according to claim 9, wherein:

the shower jet outlet comprises a plurality of jet outlet openings;

the fluid duct comprises a manifold chamber upstream of the jet outlet openings; and the valve body acts on the passage cross-section of the fluid duct between the fluid inlet and the manifold chamber.

11. The shower head according to claim 9, wherein:

the valve body is cylindrical and movable within the shower head housing in an axial direction and comprises a radially protruding annular collar including at least one valve passage opening; and the fluid duct comprises a valve chamber in which the valve body with its annular collar is guided for axial movement, at least one valve inlet opening leading into the valve chamber, and at least one valve outlet opening leading out of the valve chamber;

wherein the valve body with its annular collar reduces a passage cross-section of the at least one valve passage opening in the overpressure position relative to the normal position.

12. The shower head according to claim 11, wherein in that the at least one valve inlet opening extends axially and the at least one valve passage opening extends axially and in the normal position of the valve body in alignment to the at least one valve inlet opening.

13. The shower head according to claim 11, wherein the overpressure valve comprises a hollow cylindrical valve seat body on which the valve body is held guided and in which the valve chamber is located, wherein the at least one valve outlet opening extends with radial directional component outwards through a cylinder surface section of the valve seat body.

14. The shower head according to claim 9, further comprising a jet disk forming the shower jet outlet, wherein the valve body is located on a same side of the shower head housing as the jet disk.

15. The shower head according to claim 14, wherein the valve body in the overpressure position projects beyond an exterior side of the j et disk and in the normal position does not project beyond the exterior side of the jet disk.

16. The shower head according to claim 9, wherein the overpressure valve has a magnet arrangement which retains the valve body in the normal position by a magnetic force overridable by an overpressure in the fluid duct, wherein the magnetic force decreases in strength with increasing distance of the valve body from the normal position down to an irrelevance value in the overpressure position.

* * * * *